US006152231A

United States Patent [19]

Grenke

[11] Patent Number: 6,152,231

[45] Date of Patent: Nov. 28, 2000

[54] WELLHEAD DRIVE BRAKE SYSTEM

[76] Inventor: Edward Grenke, 86 Country Club Estates, 52328 Highway 21, Sherwood Park, Alberta, Canada, T8B 1J9

[21] Appl. No.: 09/043,277

[22] PCT Filed: Sep. 14, 1995

[86] PCT No.: PCT/CA95/00520

§ 371 Date: May 6, 1998

§ 102(e) Date: May 6, 1998

[87] PCT Pub. No.: WO97/10437

PCT Pub. Date: Mar. 20, 1997

[51] Int. Cl.[7] ..... E21B 4/20; E21B 43/00; F04C 11/00; F04C 15/04

[52] U.S. Cl. ..... 166/369; 166/68.5; 418/48; 418/69

[58] Field of Search ..... 166/68.5, 78.1, 166/369; 417/319, 426; 418/48, 69

[56] References Cited

U.S. PATENT DOCUMENTS

| | | | |
|---|---|---|---|
| 4,475,872 | 10/1984 | Foughty | 166/68.5 X |
| 4,797,075 | 1/1989 | Edwards et al. . | |
| 4,927,333 | 5/1990 | Kato | 417/319 |
| 4,993,276 | 2/1991 | Edwards | 166/68 |
| 4,997,346 | 3/1991 | Bohon | 417/319 |
| 5,251,696 | 10/1993 | Boone et al. | 166/68.5 X |
| 5,358,036 | 10/1994 | Mills | 166/68.5 |

FOREIGN PATENT DOCUMENTS

| | | |
|---|---|---|
| 3907053 A1 | 9/1990 | Germany . |
| 2210931 | 6/1989 | United Kingdom . |
| 88/07126 | 9/1988 | WIPO . |

*Primary Examiner*—George Suchfield
*Attorney, Agent, or Firm*—Shoemaker and Mattare

[57] ABSTRACT

A braking mechanism, for controlling the release of energy in a rod string (34) for a down-well rotary pump (33), incorporates a rotary member (16) positioned in the energy loop from a prime mover to the top end of the rod string, requiring that the rotary member rotate at a consistent speed ratio and direction with respect to the top end of the rod string. The rotary member drives a fluid pump through a slip clutch so that when the top end of the string rotates in the normal direction, the clutch slips and does not run the fluid pump. However when the top end of the rod string seeks to rotate in the opposite direction, for example on shut-down or power failure, the fluid pump is operated to pump fluid from a reservoir (20) and back to the reservoir in a closed loop which includes a mechanism for restricting fluid flow.

6 Claims, 2 Drawing Sheets

WELLHEAD DRIVE BRAKE SYSTEM

FIELD OF THE INVENTION

This invention relates generally to the oil production industry, and has to do particularly with improving the safety of rotary downhole pumps, particularly upon shut down or power failure.

BACKGROUND OF THE INVENTION

In the past, many conventional oil wells were operated by a downhole pump at or close to the bottom of the well, the pump being of a conventional reciprocating kind actuated by a rod string, in turn reciprocated vertically by a pump jack.

Many of these older reciprocating pumps have been recently replaced by rotary-drive progressive cavity pumps. Such rotary pumps are particularly suited for the production of crude oil laden with sand and water.

However, because of the typical depth of an oil well, the torque applied at the top of the rod string, and the resistance of the pump at the bottom, can cause the rod string to wind up like a spring, thus storing the torque energy. Whenever there is a power failure or the system is shut down, this stored torque energy, along with the energy created by the fluid head on the pump, must release itself. Without any control on the rate of backspin of the rod string, serious problems have occurred. The problems tend to be as follows:

- the motor, connected to the rod string through a reducer and a sheave and pulley arrangement, may reach reverse speeds exceeding safe limits. These speeds tend to damage the motor, and can even cause it to explode.
- one or both of the sheaves can reach speeds exceeding their limits.
- on drive configurations in which the polish rod extrudes out the top of the drive, the projecting portion can bend and break, and the broken-off portion will then be flung away from the installation, due to centrifugal force.
- without some form of braking, the rod string could uncouple, with the result that the rod string and the pump would be lost down the hole.

GENERAL DESCRIPTION OF THIS INVENTION

In view of the foregoing disadvantages, it is an object of one aspect of this invention to provide a braking mechanism for use with a rotary pumping system.

More particularly, this invention provides, for use with a pumping system in which a downhole pump has a rotor which is rotated by the bottom end of a rod string of which the top end is in turn rotated by torque energy derived from a prime mover, and in which twist energy is stored in the rod string during operation, a braking mechanism for avoiding a too sudden release of said twist energy in the rod string on shut down or power failure, the mechanism comprising:

a) a rotary member mounted so that it rotates at a consistent speed ratio and direction with respect to the top end of the rod string, b) a fluid pump, c) a reservoir containing a fluid, d) an input conduit communicating the fluid in the reservoir with the intake of said fluid pump, e) an output conduit communicating the fluid in the reservoir with the output of said fluid pump, f) an adjustable flow-control valve located in one of said conduits, and g) an over-running clutch operatively associated with the fluid pump such that, when the top end of the rod string rotates in the direction corresponding to normal operating of the downhole pump, no pumping work is done by the fluid pump, but when the top end of the rod string rotates in the direction opposite that corresponding to normal operation of the downhole pump, the fluid pump does the work of pumping the fluid out of and then back to said reservoir against a resistance determined by the setting of the valve, whereby if the stored energy in the rod string is suddenly released, the energy is dissipated in a controlled manner.

This invention further provides a pumping system comprising:

a downhole pump which includes a stator and a rotor, a rod string having a top end and a bottom end, the bottom end being connected to, supporting and rotating said rotor, a prime mover providing torque energy for rotating said top end, whereby twist energy is stored in the rod string during operation, and a braking mechanism for avoiding a too sudden release of said twist energy in the rod string on shut down or power failure, the mechanism including:

a) a rotary member inserted in the energy train between the prime mover and the top end of the rod string, such that the rotary member rotates at a consistent speed ratio and direction with respect to the top end of the rod string, b) a fluid pump, c) an over-running clutch between said rotary member and said fluid pump, connected such that when the top end of the rod string rotates in the direction corresponding to normal operation of the downhole pump, the clutch slips and does not run the fluid pump, but when the top end of the rod string rotates in the direction opposite that corresponding to normal operation of the downhole pump, the clutch powers the fluid pump, d) a reservoir containing a fluid, e) an input conduit communicating the fluid in the reservoir with the intake of said fluid pump, f) an output conduit communicating the fluid in the reservoir with the output of said fluid pump, and g) an adjustable flow-control valve located in one of said conduits, whereby the stored energy, when being released from the rod string, is made to do the work of pumping fluid around a closed circuit which includes a resistance in the form of said valve, thus dissipating said stored energy in a controlled manner.

GENERAL DESCRIPTION OF THE DRAWINGS

One embodiment of this invention is illustrated in the accompanying drawings, in which like numerals denote like parts throughout the several views, and in which:

FIG. 1 is a side elevational view of a braking mechanism in accordance with the present invention; and FIG. 2 is an end view of the braking mechanism, seen in the direction of the arrow 2 in FIG. 1.

DETAILED DESCRIPTION OF THE DRAWINGS

Figure 1:
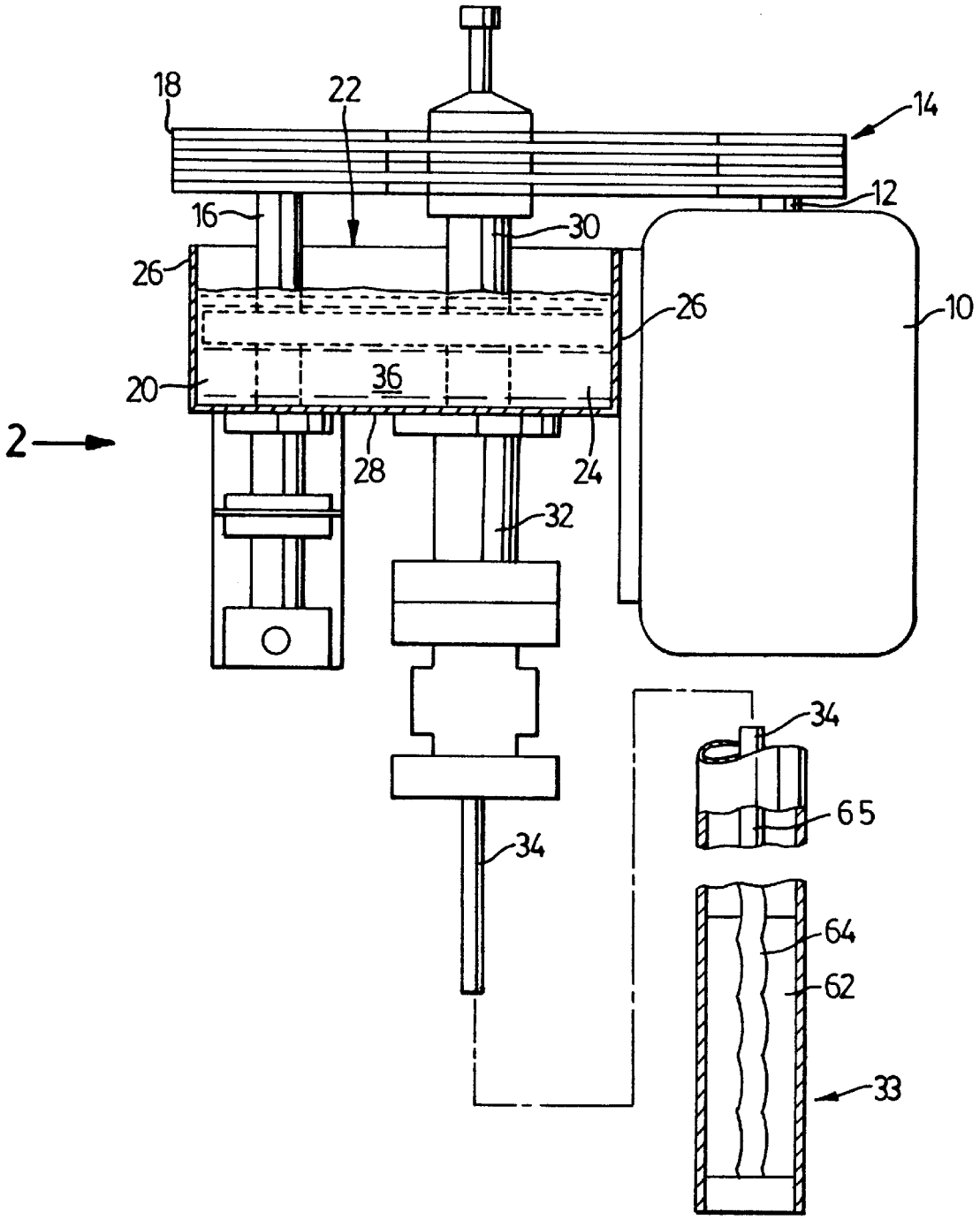

Attention is first directed to FIG. 1, which is a somewhat schematic representation of the major components of the braking system to be described herein. In FIG. 1, a prime mover is constituted by a motor 10 which has an upstanding shaft 12 carrying a sheave 14.

To the left in FIG. 1, a braking mechanism is illustrated, including a rotary member 16, carrying at the top a sheave 18 in alignment with the sheave 14. The rotary member 16 is an elongate shaft parallel with the shaft 12, and extends through the interior of a reservoir 20 which is open to the atmosphere at the top 22 and includes of two side walls 24 (only one visible in FIG. 1) and two end walls 26. A bottom wall 28 is also a part of the reservoir 20, and the shaft 16 passes through the bottom wall 28, but is sealed thereagainst to prevent leakage.

Also projecting through the interior of the reservoir 20 is a main drive shaft 30 which is supported for rotation by a seal housing 32. The main drive shaft 30 is adapted to support the top end of a rod string 34 which extends down the well. The main drive shaft 30 passes through the bottom wall 28 of the reservoir 20, and is appropriately sealed to prevent leakage.

In a preferred embodiment, the reservoir 20 is filled to about ⅔rds with hydraulic fluid 36.

Within the interior of the reservoir 20, the shafts 16 and 30 are interconnected. In one variant, each of the shafts 16 and 30 carries a pinion gear, the two gears meshing in such a way that the ratio of rotation between the shafts 16 and 30 remains constant (with the shafts rotating in opposite directions). Another variant involves the provision of a sprocket on each of the shafts 16 and 30, along with a chain engaging both sprockets. In the second case, the shafts 16 and 30 would rotate in the same direction.

Figure 2:
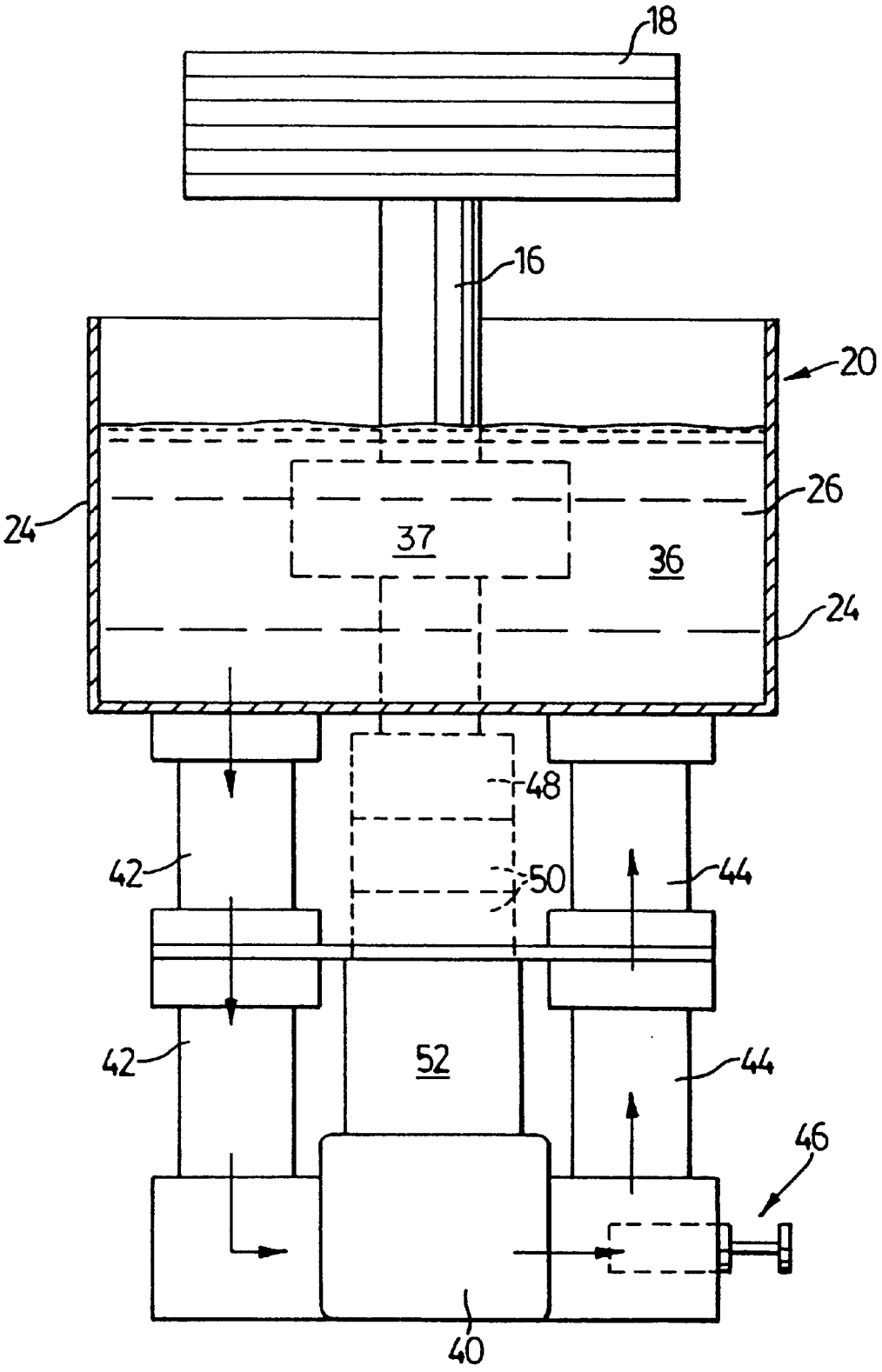

Attention is now directed to both FIGS. 1 and 2, for a more detailed description of the braking mechanism.

As best seen in FIG. 2, a hydraulic pump 40 communicates on the suction side with an intake manifold 42, and on the discharge side with a discharge manifold 44. Located in the discharge manifold 44 is a flow control valve 46 which can be manually adjusted in order to determine the resistance to flow through the discharge manifold 44. Both the manifold 42 and 44 communicate with the interior of the reservoir 20, through sealed openings.

FIG. 2 shows schematically that the shaft 16 is connected to an over-running clutch 48 which is in turn connected through flexible couplings 50 to the input power shaft 52 of the pump 40.

The over-running clutch 48 is also called a "sprague" clutch, which transmits power only in one direction of rotation, but "slips" when it rotates in the opposite direction. In the present case, the over-running clutch sends power to the pump 40 only when the top end of the rod string 34 rotates in the direction opposite that corresponding to normal operation, as it attempts to do upon power failure or shut down. However, when the rod string rotates in the direction corresponding to normal operation of the downhole pump, the clutch slips and fails to run the fluid pump 40.

In operation, whenever the downhole pump is being operated normally, the direction of rotation of the shaft 16 is such that no rotation is transmitted through the over running clutch 48 to the pump 40, and therefore no hydraulic fluid is pumped in the loop circuit constituted by the reservoir 20 and the manifolds 42 and 44.

However, when the entire pumping system shuts down for any reason, the rod string 34 will attempt to spin backwards, as the stored torque energy is released, This will cause rotation of the shaft 30, which in turn will rotate the shaft 16 through the meshing gears or the chain-locked sprockets. During this back-spin of the rod string 34, the rotational direction of the shaft 16 is such as to power the hydraulic pump 40 through the over-running clutch 48, thus causing oil to be drawn from the reservoir 20 through the intake manifold 42, and discharging it through the flow control valve 46 and into the discharge manifold 44.

The flow control valve 46 is selected such that, when substantially fully opened, the rod string 34 will be allowed to spin back at a relatively slow rate of rotation. Thus, in the case of backspin, oil from the reservoir 20 is continuously pumped in a closed loop by the pump 40, the closed loop containing an adjustable restriction in the form of the flow control valve 46.

At bottom right in FIG. 1, the bottom end 33 of the casing of a drilled well contains the stator 62 and the rotor 64 of a downhole, positive displacement rotary pump and the bottom end 65 of the rod string 34.

While our embodiment of this invention has been illustrated in the accompanying drawings and described hereinabove, it will be evident to those skilled in the art that changes and modifications may be made therein without departing from the essence of the invention, as set forth in the appended claims.

The embodiments of the invention in which an exclusive property or privilege is claimed are defined as follows:

1. For use with a pumping system in which a downhole pump has a rotor which is rotated by the bottom end of a rod string of which the top end is in turn rotated by torque energy derived from a prime mover, and in which twist energy is stored in the rod string during operation, a braking mechanism for avoiding a too sudden release of said twist energy in the rod string on shut down or power failure, the mechanism comprising:

a) a rotary member mounted so that it rotates at a consistent speed ratio and direction with respect to the top end of the rod string, b) a fluid pump, c) a reservoir containing a fluid, d) an input conduit communicating the fluid in the reservoir with the intake of said fluid pump, e) an output conduit communicating the fluid in the reservoir with the output of said fluid pump, f) an adjustable flow-control valve located in one of said conduits, and g) an over-running clutch operatively associated with the fluid pump such that, when the top end of the rod string rotates in the direction corresponding to normal operation of the downhole pump, no pumping work is done by the fluid pump, but when the top end of the rod string rotates in the direction opposite that corresponding to normal operation of the downhole pump, the fluid pump does the work of pumping the fluid out of and then back to said reservoir against a resistance determined by the setting of the valve, whereby if the stored energy in the rod string is suddenly released, the energy is dissipated in a controlled manner.

2. The braking mechanism claimed in claim 1, in which the prime mover includes a substantially vertical first shaft supporting a first sheave means, said rotary member being an elongate and substantially vertical second shaft supporting a second sheave means, and in which the braking mechanism includes belt means entrained over said first and second sheave means; said over-running clutch connecting the rotary member and the fluid pump, such that the clutch slips during normal operation of the downhole pump, but engages the rotary member with the fluid pump in the event of reverse rotation of the rod string.

3. The braking mechanism claimed in claim 2, additionally comprising a further rotary member which supports and rotates the top end of the rod string, the further rotary member being driven by said first-mentioned rotary member.

4. A pumping system comprising:

a downhole pump which includes a stator and a rotor, a rod string having a top end and a bottom end, the bottom end being connected to, supporting and rotating said rotor, a prime mover providing torque energy for rotating said top end, whereby twist energy is stored in the rod string during operation, and a braking mechanism for avoiding a too sudden release of said twist energy in the rod string on shut down or power failure, the mechanism including:

a) a rotary member inserted in the energy train between the prime mover and the top end of the rod string, such that the rotary member rotates at a consistent speed ratio and direction with respect to the top end of the rod string, b) a fluid pump, c) an over-running clutch between said rotary member and said fluid pump, connected such that when the top end of the rod string rotates in the direction corresponding to normal operation of the downhole pump, the clutch slips and does not run the fluid pump, but when the top end of the rod string rotates in the direction opposite that corresponding to normal operation of the downhole pump, the clutch powers the fluid pump, d) a reservoir containing a fluid, e) an input conduit communicating the fluid in the reservoir with the intake of said fluid pump, f) an output conduit communicating the fluid in the reservoir with the output of said fluid pump, and g) an adjustable flow-control valve located in one of said conduits, whereby the stored energy, when being released from the rod string, is made to do the work of pumping fluid around a closed circuit which includes a resistance in the form of said valve, thus dissipating said stored energy in a controlled manner.

5. The pumping system claimed in claim 4, in which the prime mover includes a substantially vertical first shaft supporting a first sheave means, said rotary member being an elongate and substantially vertical second shaft supporting a second sheave means, and in which the pumping system includes belt means entrained over said first and second sheave means.

6. The pumping system claimed in claim 5, additionally comprising a further rotary member which supports and rotates the top end of the rod string, the further rotary member being driven by said first-mentioned rotary member.

* * * * *